US007058346B2

(12) United States Patent
Domoto et al.

(10) Patent No.: US 7,058,346 B2
(45) Date of Patent: Jun. 6, 2006

(54) FAST ACTING FUSING METHOD AND APPARATUS AND AN ELECTROSTATOGRAPHIC REPRODUCTION MACHINE INCLUDING SAME

(75) Inventors: Gerald A. Domoto, Briarcliff Manor, NY (US); Nicholas Kladias, Ossining, NY (US); David H. Pan, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/972,813

(22) Filed: Oct. 25, 2004

(65) Prior Publication Data

US 2006/0088348 A1 Apr. 27, 2006

(51) Int. Cl.
*G03G 15/20* (2006.01)

(52) U.S. Cl. ..... 399/328; 219/216

(58) Field of Classification Search ..... None
See application file for complete search history.

(56) References Cited

U.S. PATENT DOCUMENTS 4,512,650 A 4/1985 Kocher
5,426,495 A * 6/1995 Sawamura et al. ..... 399/331
6,339,211 B1 1/2002 Foote et al.
6,580,895 B1 6/2003 Hirst et al.

* cited by examiner

*Primary Examiner*—Quana Grainger
(74) *Attorney, Agent, or Firm*—Tallam I. Nguti

(57) ABSTRACT

A fast acting fusing method and apparatus are provided for (a.) first moving a certain quantity of working liquid within a fusing heat pipe device from a heat transferring region of the fusing heat pipe device to an induction heating region of the fusing heat pipe device for maximizing liquid-to-device wall contact area within the induction heating region; (b.) using inductor heating coils to apply heat to the induction heating region of the fusing heat pipe device for heating the working liquid within the induction heating region; (c.) allowing heated vapors from the working liquid being heated within the induction heating region to move into the heat transferring region of the fusing heat pipe device for heating the heat transferring region; (d.) using a controller to compare heating of the heat transferring region of the fusing heat pipe device to a given heating value; and (e.) next moving the certain quantity of working liquid back from the induction heating region to the heat transferring region when heating of the heat transferring region of the fusing heat pipe device reaches the given heating value.

18 Claims, 6 Drawing Sheets

FAST ACTING FUSING METHOD AND APPARATUS AND AN ELECTROSTATOGRAPHIC REPRODUCTION MACHINE INCLUDING SAME

The present disclosure is directed to electrostatographic reproduction machines, and more particularly, concerns a fast acting fusing method and apparatus for achieving fast, instant-on heating of its fusing member during warm-up periods thereof.

Generally, the process of electrostatographic copying is initiated by exposing a light image of an original document onto a substantially uniformly charged photoreceptive member. Exposing the charged photoreceptive member to a light image discharges a photoconductive surface thereon in areas corresponding to non-image areas in the original document while maintaining the charge in image areas, thereby creating an electrostatic latent image of the original document on the photoreceptive member. This latent image is subsequently developed into a visible image by depositing charged developing material onto the photoreceptive member surface such that the developing material is attracted to the charged image areas on the photoconductive surface.

Thereafter, the developing material is transferred from the photoreceptive member to a receiving copy sheet or to some other image supporting substrate, to create an image, which may be permanently affixed thereto by a heated fixing or fusing method and apparatus, thereby providing an electrostatographic reproduction of the original document. In a final step in the process, the photoconductive surface of the photoreceptive member is cleaned with a cleaning device, such as elastomeric cleaning blade, to remove any residual developing material, which may be remaining on the surface thereof in preparation for successive imaging cycles.

The electrostatographic copying process described hereinabove, for electrostatographic imaging is well known and is commonly used for light lens copying of an original document. Analogous processes also exist in other electrostatographic printing applications such as, for example, digital laser printing where a latent image is formed on the photoconductive surface via a modulated laser beam, or ionographic printing and reproduction where charge is deposited on a charge retentive surface in response to electronically generated or stored images.

In order to fix or fuse toner images onto a substrate, the fixing or fusing method and apparatus typically includes a heated fixing or fusing member heats the toner to a point where the toner coalesces and become tacky. The heat causes the toner to flow into the fibers or pores of the substrate. The fixing or fusing method and apparatus also includes a pressure member that adds pressure to increase the toner flow. Upon cooling, the toner becomes permanently attached to the substrate. Typically such fusing takes place in a fusing nip formed by the fusing member and the pressure member, both of which are typically rollers.

Fusing members or fuser rollers have been heated in different ways, including the use of an internal radiant heater, inductive or heat pipe device heating, and by an internal resistive heating element. While fusers having a fuser roller and a backup roller have been very successful, they generally suffer from at least one significant problem: excessive warm-up time. When a typical prior art fuser roller using machine is turned on it might take several minutes for the fuser roller to warm-up to a point at which fusing can be performed. Furthermore, to conserve energy and to prolong the life of various internal components it is beneficial to remove power from the fuser roller heater when the fuser roller is not being used. However, it could then take several more minutes to re-heat the fuser roller. These delays are highly objectionable.

Prior art examples include U.S. Pat. No. 4,512,650, entitled "Fuser apparatus having a uniform heat distribution" that discloses a fusing apparatus that includes a heated fuser member, such as a fuser roller, for fusing a toner image carried by a support moved into contact with the member at a fusing region. The apparatus includes an assembly located in advance of the fusing region and external to the fuser member for maintaining the temperature of the fuser member at the fusing region substantially uniform along the length thereof by redistributing heat from hotter regions to colder regions along the length of the member. The assembly preferably includes a heat pipe that engages the fuser member in advance of the fusing region. The heat pipe may also apply release material to the fuser member and be heated to heat the fuser member.

U.S. Pat. No. 6,339,211, entitled "Reducing a temperature differential in a fixing device" discloses a heat pipe included in a fuser, so that heat flows from higher temperature regions on the surface of the fuser to lower temperature regions on the surface of the fuser, thereby reducing the peak magnitude of the fuser surface temperature and the magnitude of the temperature differential over the length of the fuser.

U.S. Pat. No. 6,580,895 entitled "Fusing system including a heat distribution mechanism" that discloses a fusing system for fusing toner to a recording medium. In one embodiment, the fusing system contains a fuser roller configured as a heat pipe including an inner tube and a coaxial outer tube that is mounted to the inner tube, the inner and outer tubes defining an interior space there between that is adapted to contain a liquid and to be evacuated so as be maintained in a vacuum, and a pressure roller in contact with the fuser roller. In another embodiment, the fusing system contains a fuser roller, a pressure roller in contact with the fuser roller, and an external heating roller in contact with the fuser roller, the external heating roller being configured as a heat pipe including an inner tube and a coaxial outer tube that is mounted to the inner tube, the inner and outer tubes defining an interior space there between that is adapted to contain a liquid and to be evacuated so as be maintained in a vacuum.

SUMMARY

In accordance with the present disclosure, there have been provided a fast acting fusing method and apparatus for (a.) first moving a certain quantity of working liquid within a fusing heat pipe device from a heat transferring region of the fusing heat pipe device to an induction heating region of the fusing heat pipe device for maximizing liquid-to-device wall contact area within the induction heating region; (b.) using inductor heating coils to apply heat to the induction heating region of the fusing heat pipe device for heating the working liquid within the induction heating region; (c.) allowing heated vapors from the working liquid being heated within the induction heating region to move into the heat transferring region of the fusing heat pipe device for heating the heat transferring region; (d.) using a controller to compare heating of the heat transferring region of the fusing heat pipe device to a given heating value; and (e.) next moving the certain quantity of working liquid back from the induction heating region to the heat transferring region when heating of the heat transferring region of the fusing heat pipe device reaches the given heating value.

BRIEF DESCRIPTION OF THE DRAWINGS

The foregoing and other features of the instant disclosure will be apparent and easily understood from a further reading of the specification, claims and by reference to the accompanying drawings in which:

DETAILED DESCRIPTION

While the present disclosure will be described hereinafter in connection with a preferred embodiment thereof, it should be understood that it is not intended to limit the disclosure to that embodiment. On the contrary, it is intended to cover all alternatives, modifications and equivalents as may be included within the spirit and scope of the disclosure as defined in the appended claims.

Figure 1:
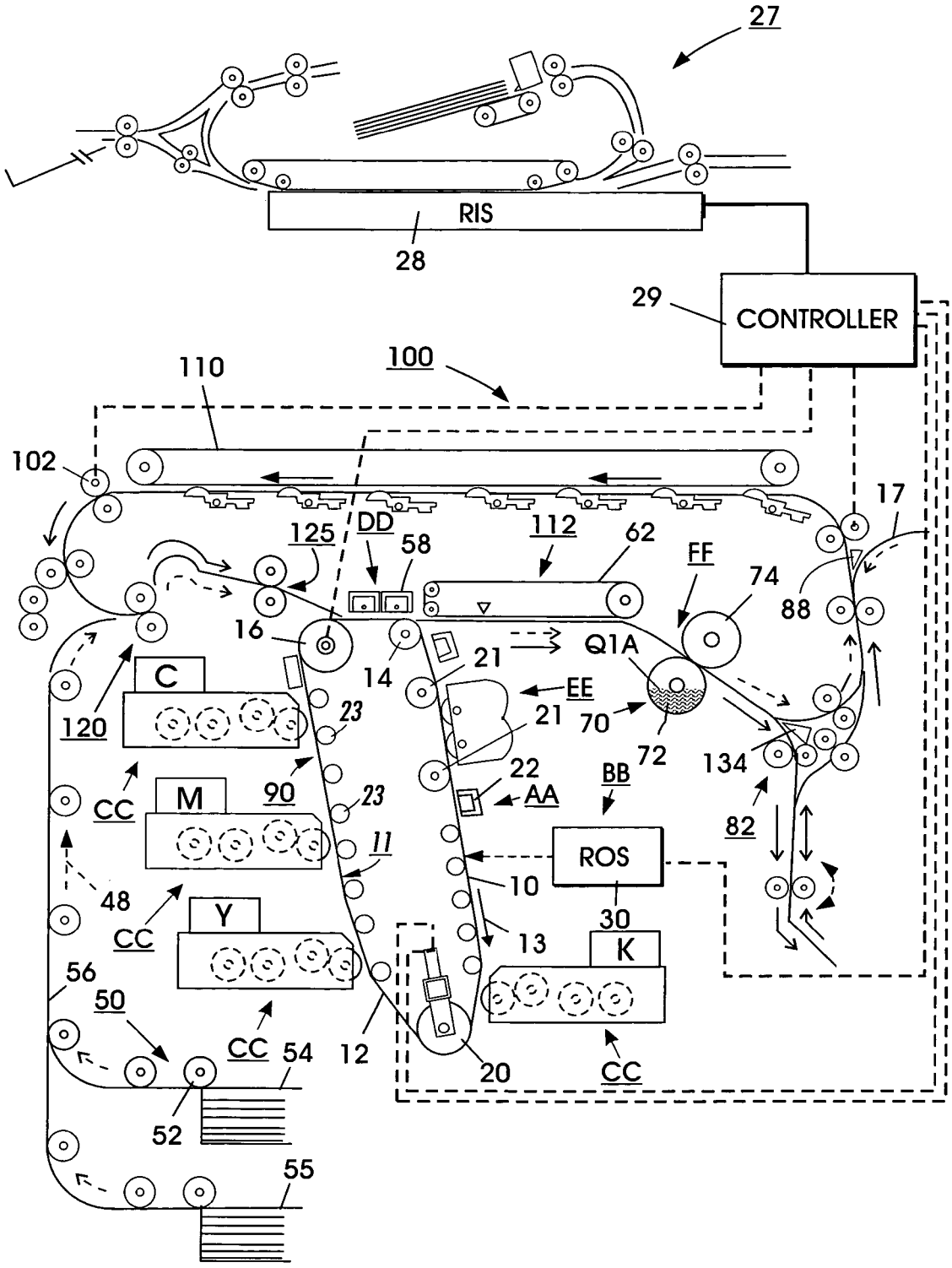
FIG. 1 is a schematic elevational view of an electrostatographic reproduction machine depicting the fast acting fusing method and apparatus of the present disclosure.

FIG. 1 schematically illustrates an electrostatographic reproduction machine, which generally employs a photoconductive belt 10 mounted on a belt support module 90. Preferably, the photoconductive belt 10 is made from a photoconductive material coated on a ground layer that, in turn, is coated on an anti-curl backing layer. Belt 10 moves in the direction of arrow 13 to advance successive portions sequentially through the various processing stations disposed about the path of movement thereof. Belt 10 is entrained as a closed loop 11 about stripping roll 14; drive roll 16, and idler roll 21. Belt 10 as loop 11 is also entrained about the fast acting fusing apparatus 70 of the present disclosure. As drive roll 16 rotates, it advances belt 10 in the direction of arrow 13.

Initially, a portion of the photoconductive belt surface passes through charging station AA. At charging station AA, a corona-generating device indicated generally by the reference numeral 22 charges the photoconductive belt 10 to a relatively high, substantially uniform potential.

As further shown, the reproduction machine 8 includes a controller or electronic control subsystem (ESS), indicated generally be reference numeral 29 which is preferably a self-contained, dedicated mini-computer having a central processor unit (CPU), electronic storage, and a display or user interface (UI). The ESS 29, with the help of sensors and connections, can read, capture, prepare and process image data and machine status information. As such, it is the main control system for components and other subsystems of machine 8 including the fast acting fusing method and apparatus 70 of the present disclosure.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image which is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. The ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station CC, which includes four developer units containing cmyk color toners, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station DD. A print sheet 48 is advanced to the transfer station DD, by a sheet feeding apparatus 50. Preferably, sheet-feeding apparatus 50 includes a feed roll 52 contacting the uppermost sheet of stack 54. Feed roll 52 rotates to advance the uppermost sheet from stack 54 to vertical transport 56. Vertical transport 56 directs the advancing sheet 48 of support material into registration transport 57 past image transfer station DD to receive an image from photoreceptor belt 10 in a timed sequence so that the toner powder image formed thereon contacts the advancing sheet 48 at transfer station DD. Transfer station DD includes a corona-generating device 58, which sprays ions onto the backside of sheet 48. This attracts the toner powder image from photoconductive surface 12 to sheet 48. After transfer, sheet 48 continues to move in the direction of arrow 60 by way of belt transport 62, which advances sheet 48 to fusing station FF.

Fusing station FF includes the fast-acting fusing apparatus or fuser assembly indicated generally by the reference numeral 70, which heats and permanently affixes the transferred toner powder image to the copy sheet. In accordance with the present disclosure, fast-acting heat pipe fusing apparatus 70 includes a heat pipe device 72 and a pressure roller 74 forming a fusing nip 75, with the powder image on the copy sheet contacting heat pipe device 72. The pressure roller is crammed against the heat pipe device to provide the necessary pressure to fix the toner powder image to the copy sheet. The heat pipe device as shown is internally heated by induction heated working liquid Q1A, Q1B and vapors Vx as described below. In operation, the sheet then passes through fast-acting fusing apparatus 70 where the image contacts heat pipe device 72, is heated and is permanently fixed or fused to the sheet.

After passing through fast-acting heat pipe fusing apparatus 70, a gate either allows the sheet to move directly via output 17 to a finisher or stacker, or deflects the sheet into the duplex path 100, specifically, first into single sheet inverter 82 here. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles adhering to photoconductive surface 12 are removed therefrom at cleaning station EE. Cleaning station EE includes a rotatably mounted fibrous brush in contact with photoconductive surface 12 to disturb and remove paper fibers and a cleaning blade to remove the non-transferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

Figure 2:
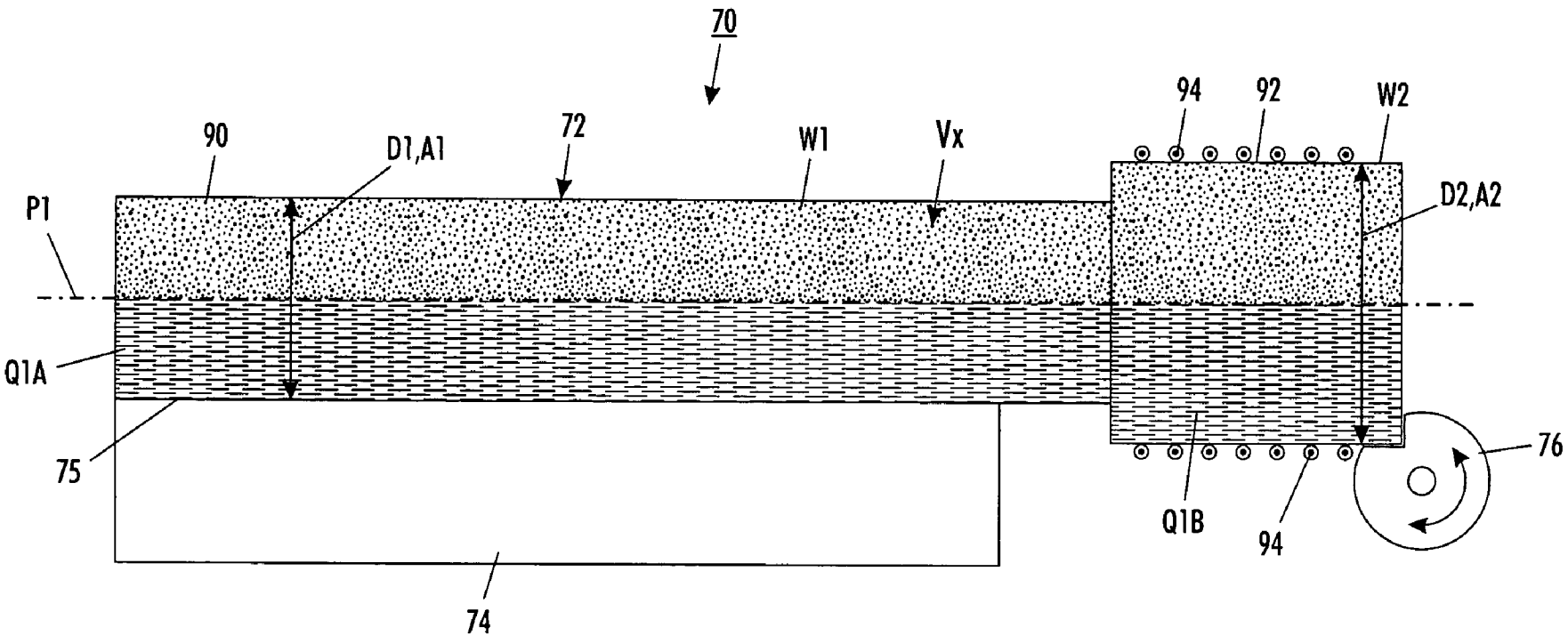
FIG. 2 illustrates a side view schematic of the fast acting fusing apparatus of the present disclosure in a horizontal operating position.
Figure 3:
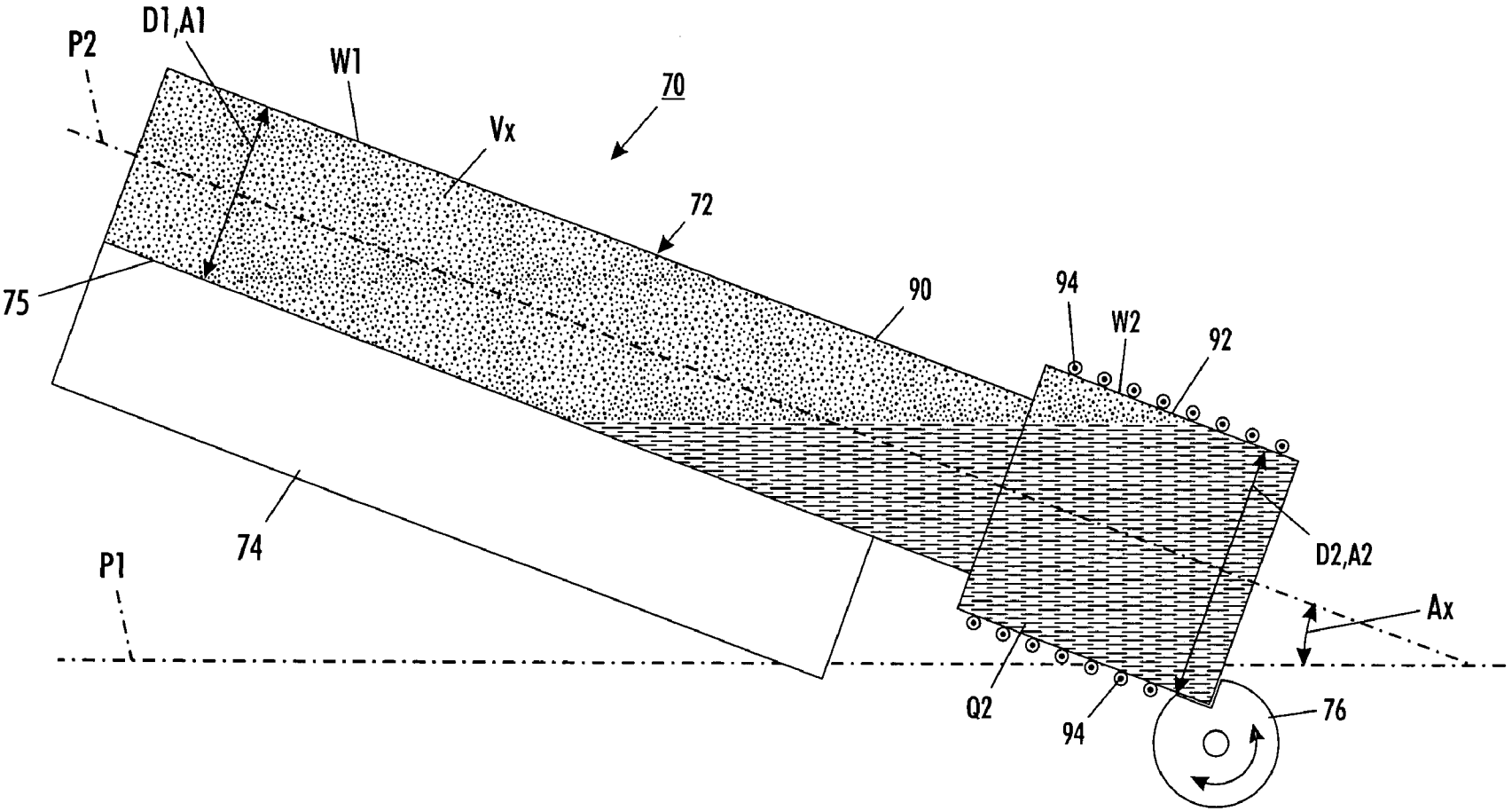
FIG. 3 illustrates the fast acting fusing apparatus of FIG. 2 in an angled start-up heating position.

Referring now to FIGS. 1–3, details of the fast-acting fusing apparatus 70 and corresponding method of the present disclosure are illustrated in detail. As illustrated the fast acting fusing apparatus 70 includes a fusing nip 75, fusing nip forming means comprising a pressure member 74, and a fusing heat pipe device 72 containing a first quantity Q2 of working liquid for providing fusing heat to the fusing nip 75. The fusing heat pipe device 72 includes (i) heat conductive walls W1, W2 defining a hollow interior containing working liquid Q1A, Q1B; (ii) a heat transferring region 90 having a first cross-sectional area A1 with a first diameter D1; and (iii) an induction heating region 92 having a second cross-sectional area A2 with diameter D2, greater than the first diameter D1, for receiving and containing a greater quantity Q2 than the normal quantity Q1B of working liquid therein (FIG. 3) during warm up periods of the fusing apparatus.

The fast acting fusing method of the present disclosure includes (a) first moving the certain quantity Q1A of working liquid within the fusing heat pipe device 72 from the heat transferring region 90 to the induction heating region 92 thereof for maximizing liquid-to-wall contact area within the induction heating region 92 during warm-up; (b.) applying heat using induction heating coils 94 to the induction heating region 92 for heating the working liquid Q2 (Q1A plus Q1B) within the induction heating region 92 during warm-up; (c.) allowing heated vapors Vx from the heated working liquid Q2 within the induction heating region to move into the heat transferring region 90 of the fusing heat pipe device for heating the heat transferring region; (d.) using the controller 29 to compare heating of the heat transferring region of the fusing heat pipe device to a given heating value; and (e.) next moving the certain quantity Q1A of working liquid back from the induction heating region 92 to the heat transferring region 90 when heating of the heat transferring region of the fusing heat pipe device reaches the given heating value.

The fast acting fusing apparatus 70 as shown may include tilting means 76 for moving the induction heating region 92 of the fusing heat pipe device 72 from the operating horizontal position P1 (FIG. 2) to an angled or tilted position P2 (FIG. 3) where the induction heating region is lower or below the heat transferring region 90 thereof. This thus can allow the method steps of flowing the quantity of working liquid Q1A gravitationally from the heat-transferring region 90 to the induction-heating region 92 during warm-up periods. The tilting means 76 can be any suitable device of those known in the art for moving the device 72 or assembly 70 between positions P1 and P2. As such, means 76 can be reversible and thus would allow flowing the working liquid gravitationally back from the induction heating region 92 by tilting the induction heating region from the angled position P2 back to the horizontal position or orientation P1

The fusing heat pipe device 72 is external to and in contact with the other fusing member 74. The fusing heat pipe device 72 comprises a fuser roller in fusing nip contact with the pressure member 74. The heat conductive walls W1 in the heat-transferring region 90 are made of a first material M1, such as aluminum, and those W2 in the induction-heating region 92 are made of a second material M2, such as copper. The first cross-sectional area A1 having diameter D1 is circular, and the second cross-sectional area A2 with diameter D2 is also circular.

Thus in accordance with the present disclosure, the objective is to maintain as much working liquid Q2 (Q1A+Q1B) in the induction heating zone or region 92 during warm-up periods as is possible so that film boiling may not occur. The induction heated end or region 92 of the heat pipe fuser roll or fusing device 72 has a larger diameter D2 than the diameter D1 for the rest 90 of the roll 72. The heat pipe fuser roll or fusing heat pipe device 72 is normally in the horizontal operating position P1 and is only angled (Ax) by the tilting means 76 during warm-up periods, but it could also be mounted for operation in the machine at the slight angle Ax.

Figure 4:
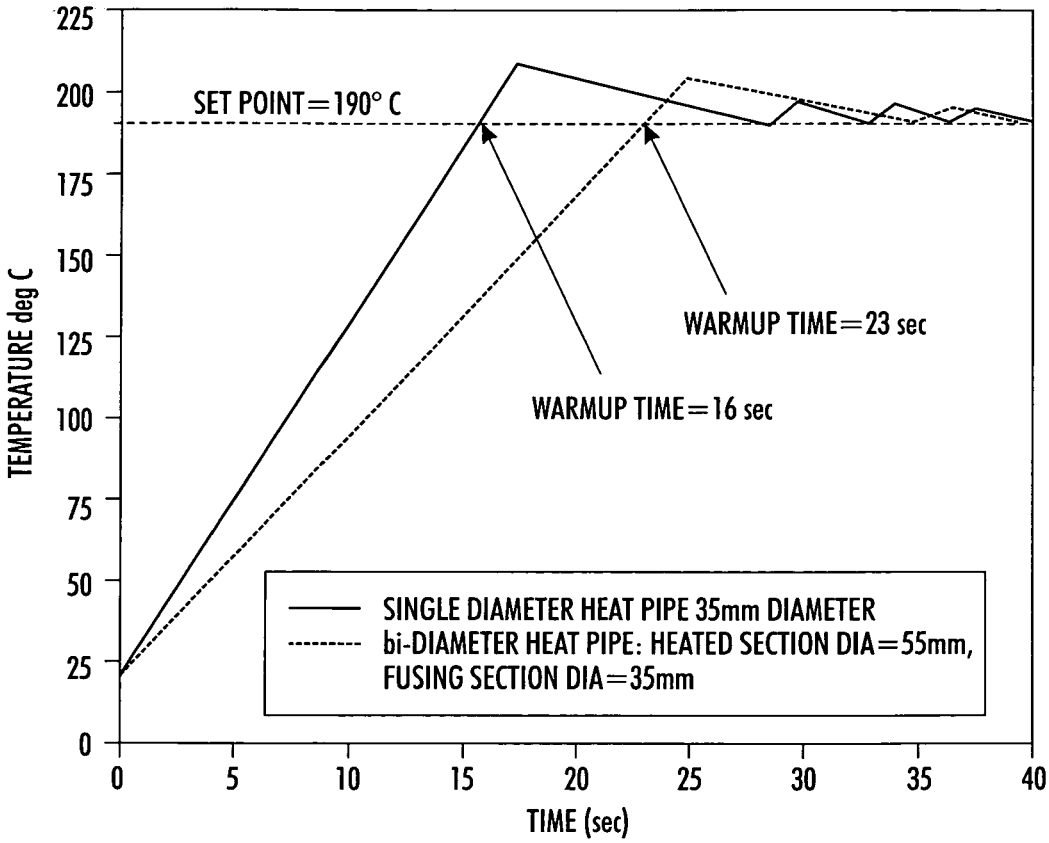
FIG. 4 is a graphical illustration of fuser temperature in accordance with the present disclosure as a function of time.

Referring now to FIG. 4, as compared to a conventional single diameter or constant diameter horizontal heat pipe (not shown) with the same volume of liquid Q1A+Q1B, the bi-diameter or D1, D2 diameter device of this disclosure results in a much larger area of contact between liquid and heated surface. In addition, since the walls W2 of the heated end 92 of the device 72 of the present disclosure may require a different material M2 for purposes of induction heating, it would be feasible to construct this bi-diameter device 72 in two different pieces and then join the two parts together. Alternatively, one can make the walls W1, W2 of both regions 90, 92 out of a single material and thus begin with a single diameter tube of induction heatable material, then use a secondary swaging or forging operation to create the short, larger diameter D2 heating boiling region.

In the alternative where the slight tilt (Ax) is only needed to move the working liquid Q2 before the warm-up cycle is started, a simple mechanism 76 can be activated to tilt just the device 72 or the entire assembly 70 to position P2 just prior to the warm-up period. As pointed out above, this will cause practically all the working liquid Q1A, Q1B (as Q2) to flow gravitationally to the larger diameter D2 high-power induction-heating region 92 as shown. The tilted device can then be returned to the normal horizontal position P1 after the warm-up is completed. In either case, the diameter D2 should be such that the heating region 92 will be large enough to accommodate all working liquid Q2 during the warm-up period.

In operation, for instant-on type results, the highest power is applied during warm-up from a cold start. During a cold start, the device and method of this disclosure insure that all of the liquid Q2 begins in the larger diameter boiler or heating region 92 of the heat pipe fusing device 72 as shown. The induction heating by the induction coils 94 of this region 92 causes the evaporation of some of the working liquid Q2, and the vapor flows Vx rise to the condensor or heat transferring region 90 as shown. The flow of the vapors Vx is normally very rapid, and condensation of the vapors Vx results in rapid heating of the walls W1 of the colder condensor region during such start up. The energy transport is so efficient from the boiler or heating region 92 to the condensor region 90 so that the heat pipe device 72 remains very close to uniform in axial temperature distribution during the warm-up process and during fusing. Movement of practically all the working liquid Q1A plus Q1B to the heating region during warm-up results in the maximum area of liquid-to-heated metal contact for a given volume of working fluid during a cold start. It should be noted that since the energy transport is limited by the peak nucleate boiling heat flux, maximizing the liquid to heating surface contact area also maximizes the heating rate and allows the most rapid warm-up possible.

As pointed out above, using the controller 29, the step of comparing heating of the heat transferring region 90 may comprise comparing induction heating time to a given heating time value, and it may equally comprise comparing a temperature of the heat transferring region 90 to a given temperature value. In either case, when the given time value or given temperature value is reached, warm-up ceases and the tilted device is returned from position P2 to position P1.

Figure 5:
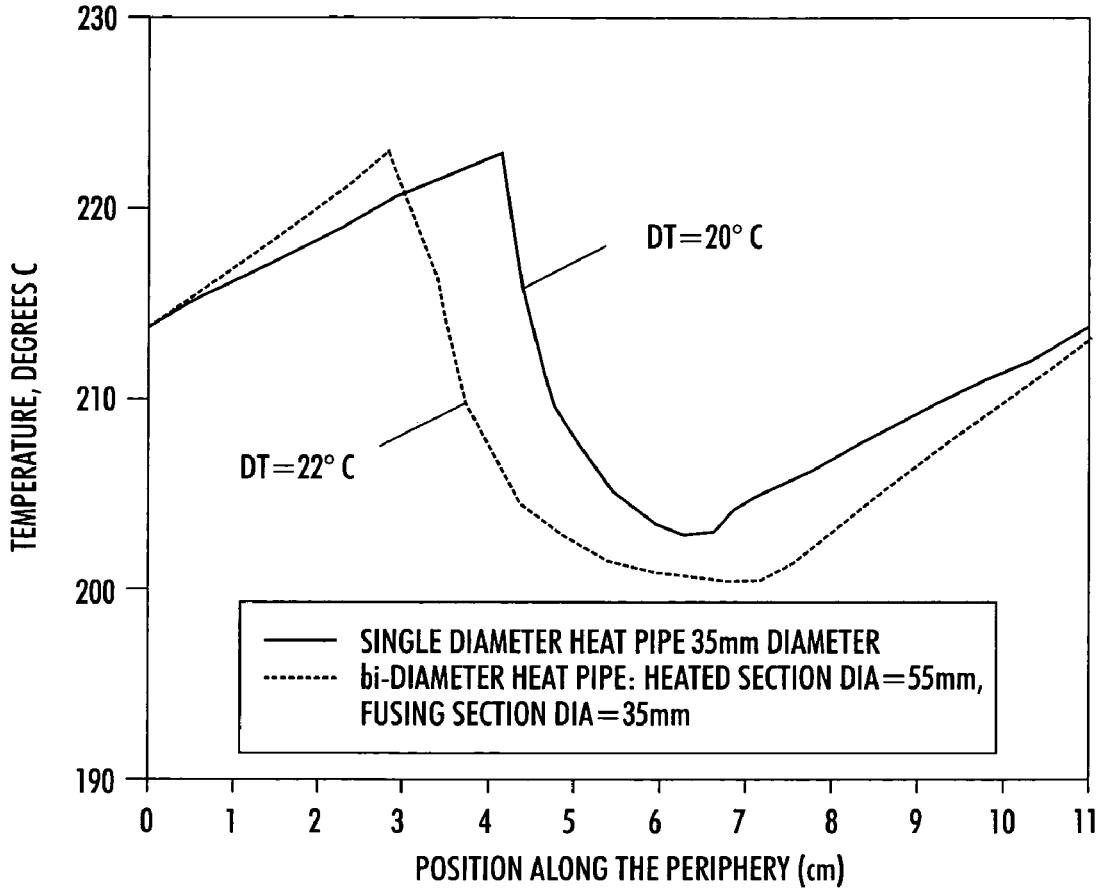
FIG. 5 is a graphical illustration of fuser roll inner temperature along its periphery.

FIG. 4 for example shows heat pipe fuser temperature as a function of time in two configurations: (i) a conventional single 35 mm diameter heat pipe device, and (ii) a bi-diameter heat pipe device of the present disclosure where the diameter of heat transferring region is 35 mm and that of the heating region is larger at 55 mm. In both cases the heat flux per liquid contact area was 71 W/cm2 and with this heat flux the temperature difference between the inner wall of the heat pipe and the liquid is about 20° C. which is less than the dry-out excess temperature (30° C.) (See FIG. 5). For both cases the power was held fixed at 1250 watts so that the liquid contact area was the same for both cases. It was found that the bi-diameter configuration of the present disclosure however allowed use of less working fluid so that faster warm-up was enabled. From FIG. 4 we can see that a 7 sec benefit in warm-up time is realized by increasing the diameter of the heating region relative to that of the heat transferring region, for example, from 35 mm to 55 mm.

Figure 6:
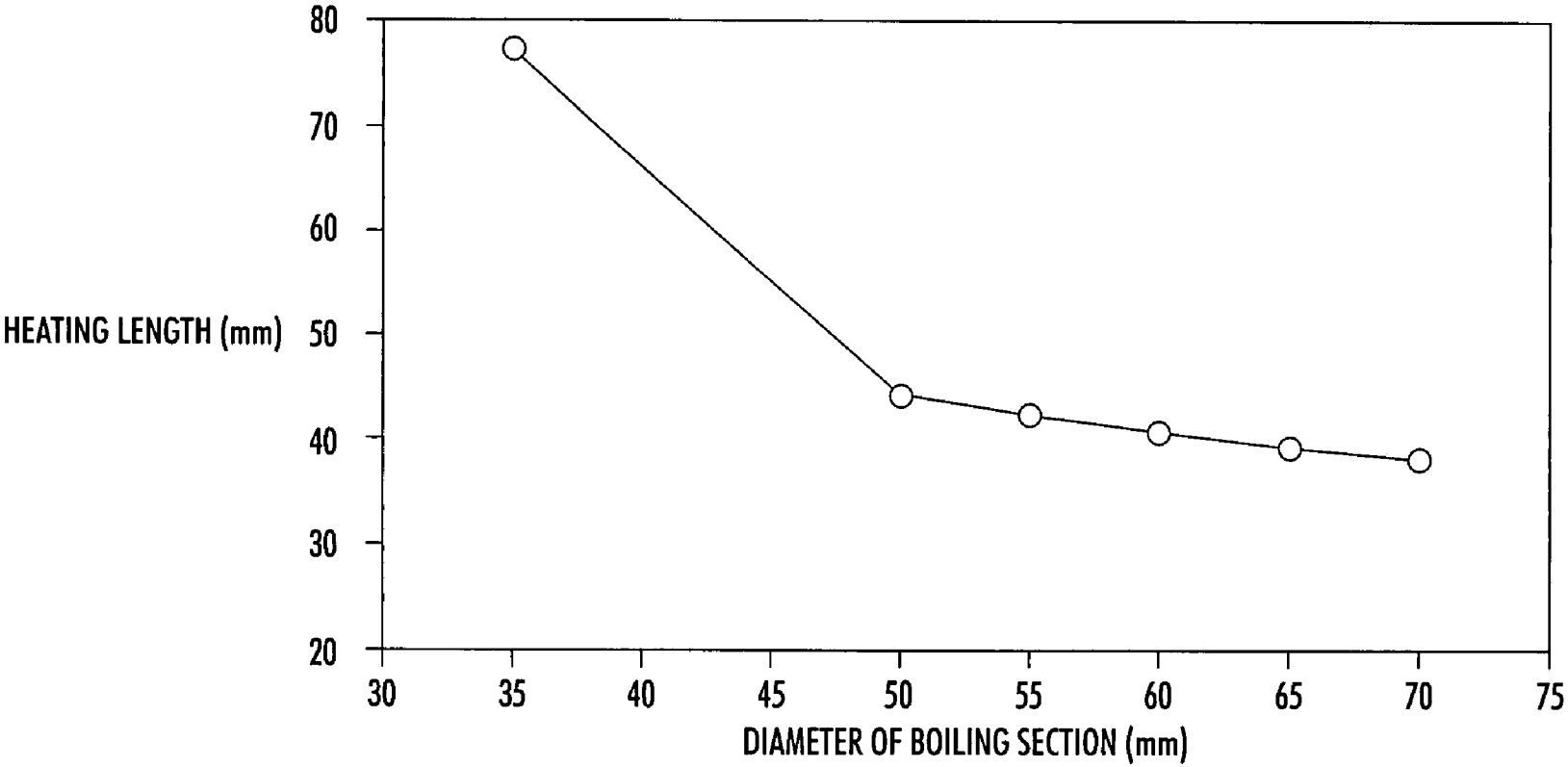
FIG. 6 is a graphical illustration of length of heated region as a function the diameter of the heated region in accordance with the present disclosure.

Another advantage that can be realized by increasing the diameter of the heating region 92 is that for the same heat flux input and same liquid volume, the length of the heating region 90 can be shortened. FIG. 6 for example shows the length of the heating region 92 as a function of its diameter for the same heat flux input, 71 W/cm2. Here we have assumed that all of the liquid can be placed in the larger diameter region 92 for warm-up for the bi-diameter cases in accordance with the present disclosure. The above results have been obtained by Fuser 3D, thermal simulation model.

As can be seen, there have been provided a fast acting fusing method and apparatus for (a.) first moving a certain quantity of working liquid within a fusing heat pipe device from a heat transferring region of the fusing heat pipe device to an induction heating region of the fusing heat pipe device for maximizing liquid-to-device wall contact area within the induction heating region; (b.) using inductor heating coils to apply heat to the induction heating region of the fusing heat pipe device for heating the working liquid within the induction heating region; (c.) allowing heated vapors from the working liquid being heated within the induction heating region to move into the heat transferring region of the fusing heat pipe device for heating the heat transferring region; (d.) using a controller to compare heating of the heat transferring region of the fusing heat pipe device to a given heating value; and (e.) next moving the certain quantity of working liquid back from the induction heating region to the heat transferring region when heating of the heat transferring region of the fusing heat pipe device reaches the given heating value.

While the disclosure has been described with reference to the structure herein disclosed, it is not confined to the details as set forth and is intended to cover any modification and changes that may come within the scope of the following claims.

What is claimed is:

1. A fast acting fusing method comprising:

(a.) first moving a certain quantity of working liquid within a fusing heat pipe device from a heat transferring region of said fusing heat pipe device to an induction heating region of said fusing heat pipe device for maximizing liquid-to-device wall contact area within said induction heating region;

(b.) applying heat to said induction heating region of said fusing heat pipe device for heating said working liquid within said induction heating region;

(c.) allowing heated vapors from said working liquid being heated within said induction heating region to move into said heat transferring region of said fusing heat pipe device for heating said heat transferring region;

(d.) comparing heating of said heat transferring region of said fusing heat pipe device to a given heating value; and (e.) next moving said certain quantity of working liquid back from said induction heating region to said heat transferring region when heating of said heat transferring region of said fusing heat pipe device reaches said given heating value.

2. The method of claim 1, wherein said first moving of a certain quantity of working liquid comprises flowing working liquid within said fusing heat pipe device gravitationally by tilting said induction heating region of said fusing heat pipe device to an orientation below said heat transferring region thereof.

3. The method of claim 1, wherein said comparing of heating of said heat transferring region comprises comparing induction heating time to a given heating time value.

4. The method of claim 1, wherein said comparing of heating of said heat transferring region comprises comparing a temperature of said heat transferring region to a given temperature value.

5. The method of claim 1, wherein said next moving of said certain quantity of working liquid comprises flowing working liquid within said fusing heat pipe device gravitationally back from said induction heating region by tilting said induction heating region of said fusing heat pipe device from said orientation below said heat transferring region back to a horizontal orientation with said heat transferring region thereof.

6. A fast acting fusing apparatus comprising:

(a.) fusing nip forming means including a pressure member;

(b.) a fusing heat pipe device for providing fusing heat to said fusing nip, said fusing heat pipe device including:

(i) heat conductive walls defining a hollow interior containing working liquid;

(ii) a heat transferring region having a first cross-sectional area; and (iii) an induction heating region, having a second cross-sectional area greater than said first cross-sectional area, for receiving and containing, during warm up periods of said fusing apparatus, a greater quantity of working liquid than contained therein during non-warm up periods; and (c.) tilting means for moving said induction heating region of said fusing heat pipe device from a horizontal orientation to an orientation below said heat transferring region thereof.

7. The fast acting fusing apparatus of claim 6, wherein said fusing heat pipe device is external to and in contact with a pressure member.

8. The fast acting fusing apparatus of claim 6, wherein said fusing heat pipe device comprises a fuser roller in fusing nip contact with said pressure member.

9. The fast acting fusing apparatus of claim 6, wherein said heat conductive walls are made of a first material in said heat transferring region and of a second material in said induction heating region.

10. The fast acting fusing apparatus of claim 6, wherein said first cross-sectional area is circular.

11. The fast acting fusing apparatus of claim 6, wherein said second cross-sectional area is circular.

12. The fast acting fusing apparatus of claim 9 wherein said first material comprises aluminum.

13. The fast acting fusing apparatus of claim 9 wherein said second material comprises a copper.

14. An electrostatographic reproduction machine comprising:

(a) a moveable image bearing member having an image bearing surface;

(b) imaging means for forming a developable latent image on said image bearing surface of said image bearing member;

(c) a development apparatus containing developer material having toner for developing said developable latent image into a toner image;

(d) transfer means for transferring said toner image onto a copy substrate; and (e) a fast acting fusing apparatus having a fusing nip, fusing nip forming means, and a fusing heat pipe device for providing heat to said fusing nip, said fusing heat pipe device including:

(i) heat conductive walls defining a hollow interior containing working liquid, said heat conductive walls being made of a first material in said heat transferring region and of a second material in said induction heating region;

(ii) a heat transferring region having a first cross-sectional area; and (iii) an induction heating region, having a second cross-sectional area greater than said first cross-sectional area, for receiving and containing, during warm up periods of said fusing apparatus, a greater quantity of working liquid than contained therein during non-warm up periods.

15. The electrostatographic reproduction machine of claim 14, wherein said fusing heat pipe device is external to and in contact with a pressure member.

16. The electrostatographic reproduction machine of claim 14, wherein said fusing heat pipe device comprises a fuser roller in fusing nip contact with said pressure member.

17. The electrostatographic reproduction machine of claim 14, including tilting means for moving said induction heating region of said fusing heat pipe device from a horizontal orientation to an orientation below said heat transferring region thereof.

18. The electrostatographic reproduction machine of claim 14, wherein said first cross-sectional area is circular.

* * * * *